United States Patent [19]

Anglemyer

[11] 4,356,916

[45] Nov. 2, 1982

[54] CARRYING CASE FOR CEMENT FINISHER'S TOOLS

[76] Inventor: Edward B. Anglemyer, P.O. Box 777, Monroe, Wash. 98272

[21] Appl. No.: 226,584

[22] Filed: Jan. 21, 1981

[51] Int. Cl.[3] ..... A45C 11/00; B65D 85/00

[52] U.S. Cl. ..... 206/372; 206/373; 312/209; 312/DIG. 33; 211/60 T

[58] Field of Search ..... 206/372, 373, 349, 362, 206/209; 321/209, DIG. 33; 211/60 T

[56] References Cited

U.S. PATENT DOCUMENTS

| | | | |
|---|---|---|---|
| 512,101 | 1/1894 | Eastes | 312/209 |
| 1,739,793 | 12/1929 | Hardt | 206/373 |
| 2,270,593 | 1/1942 | Kurath et al. | 206/209 |
| 2,479,509 | 8/1949 | Pichniarczyk | 206/362 |
| 2,529,372 | 11/1950 | Burns | 211/60 T |

*Primary Examiner*—William T. Dixson, Jr.

[57] ABSTRACT

A carying case for cement finisher's tools includes a generally rectangular box. A vertical interior wall is spaced from an exterior wall, to which it is joined by a shelf. Finishing trowels are hung on this interior wall by their handles. A bar adjacent and parallel to another exterior wall receives additional finishing trowels. Pockets are provided for mason's and margin trowels. The interior wall and shelf form a receptacle for gloves and smaller objects, while the space between the interior wall and the other exterior wall provides room for boots and larger objects.

9 Claims, 3 Drawing Figures

CARRYING CASE FOR CEMENT FINISHER'S TOOLS

BACKGROUND OF THE INVENTION

This invention relates to a carrying case for cement finisher's tools.

Specialized carrying cases for tools have been provided for many different trades, such as carpenters, plumbers and mechanics. In contrast, so far as I am aware, no such cases are avilable to cement finishers. Rather, it has been their practice to utilize makeshift arrangements, such as five-gallon cans fitted with wire bails, or canvas bags. This is awkward and inconvenient.

A cement finisher's tools include finishing trowels of several sizes, a margin trowel and a bricklayer's or mason's trowel. In addition, he will have gloves and boots which it would be desirable to put in the case.

The object of my invention is to provide a case which will maintain these tools and other objects in positions in which they are readily accessible and stable.

SUMMARY OF THE INVENTION

The invention consists of a case having a removable cover and a bail for carrying it. The case and cover are made of rigid material such as metal, molded plastic, or plywood. On its interior the case comprises a vertical wall on which finishing trowels are hung, and a floor joining the interior wall to a sidewall of the case to form a pocket to receive gloves, etc. A bar parallel to and adjacent to another sidewall receives other finishing trowels. Other pockets are provided for the mason's trowel and the margin trowel. The central portion is unobstructed and provides space for boots.

DETAILED DESCRIPTION

Figure 2:
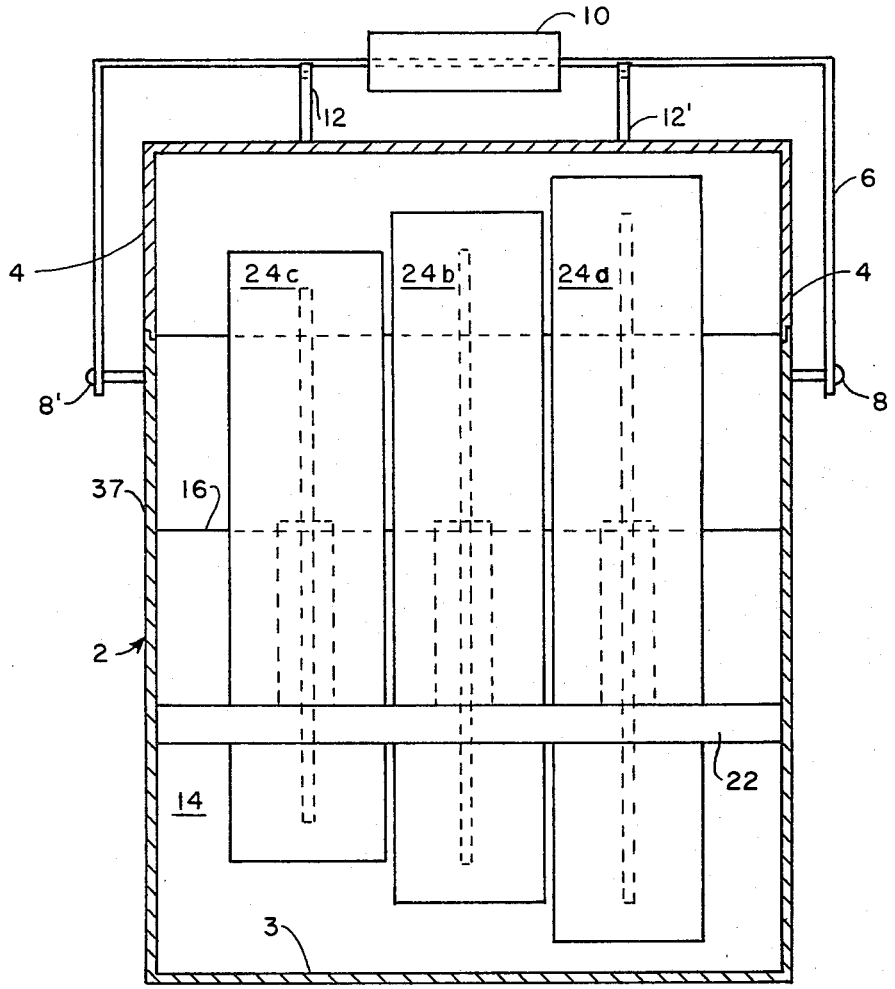
FIG. 2 is a vertical section taken on the line 2—2 of FIG. 1, but with the cover in place and the bail in position for carrying.

The case includes a body portion 2 and a removable cover 4, formed of rigid material such as metal, molded plastic or plywood. A bail 6 for carrying in pivoted at 8,8' to the ends of body 2. It is preferably provided with a handle 10. One or more detents 12,12' on the cover 4 engage the bail 6 at the handle 10 or elsewhere to hold the cover in place. Detents 12,12' are preferably made of firm vulcanized rubber or similar resilient material. Within body 2 is a vertical interior wall 14, spaced from a side wall 5 of body 2. The lower edge of the interior wall may rest on the bottom 3 of body 2 as shown, or may be spaced somewhat above it, as will later be explained. Below the upper edge 16 of the interior wall 14 is a shelf 18 joining the interior wall to the side wall 5 of body 2. Adjacent sidewall 5', which is opposite sidewall 5, is a bar 20. This bar preferably comprises a metallic core 21 and a resilient covering 23 which may simply be a piece of rubber hose. A similar bar 22 having a metallic core 25 and a resilient covering 27 may be provided adjacent interior wall 14.

The drawing shows a number of finishing trowels in place. As mentioned above, they are of different sizes. In FIG. 2, I show a 20-inch trowel **24*a*, and 18-inch trowel 24*b* and a 16-inch trowel 24*c*, which are hung on wall 14, with their blades between this wall and bar 22, while in FIG. 3, I show, in addition to 20-inch trowel 24*a*, a 14-inch trowel 24*d***.

Figure 1:
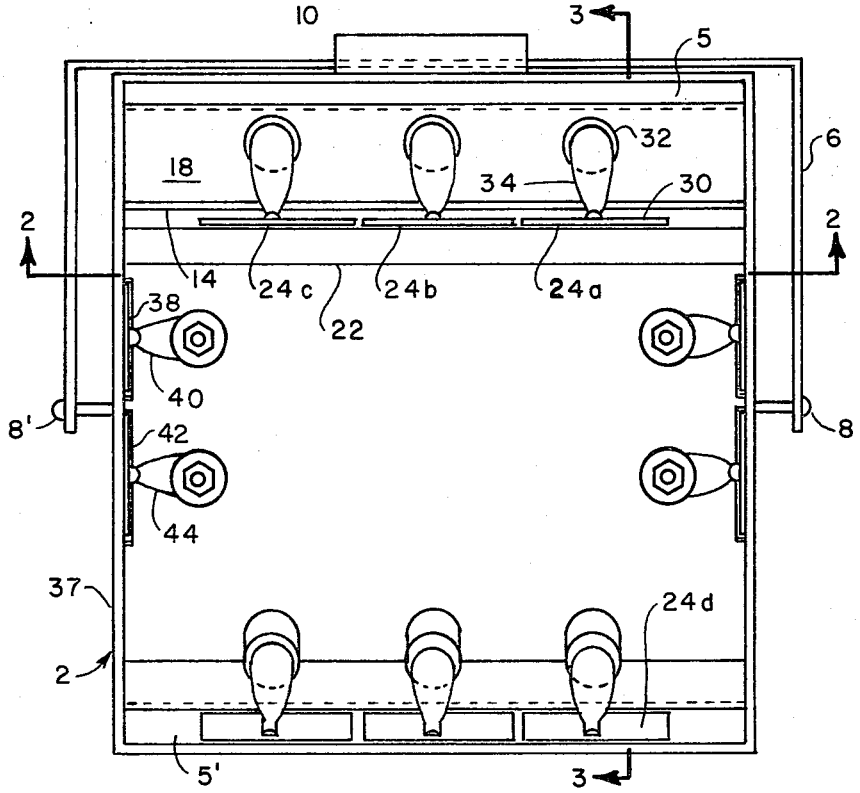
FIG. 1 is a top plan view of the case, with the cover removed, the trowels in place and the bail at one side.
Figure 3:
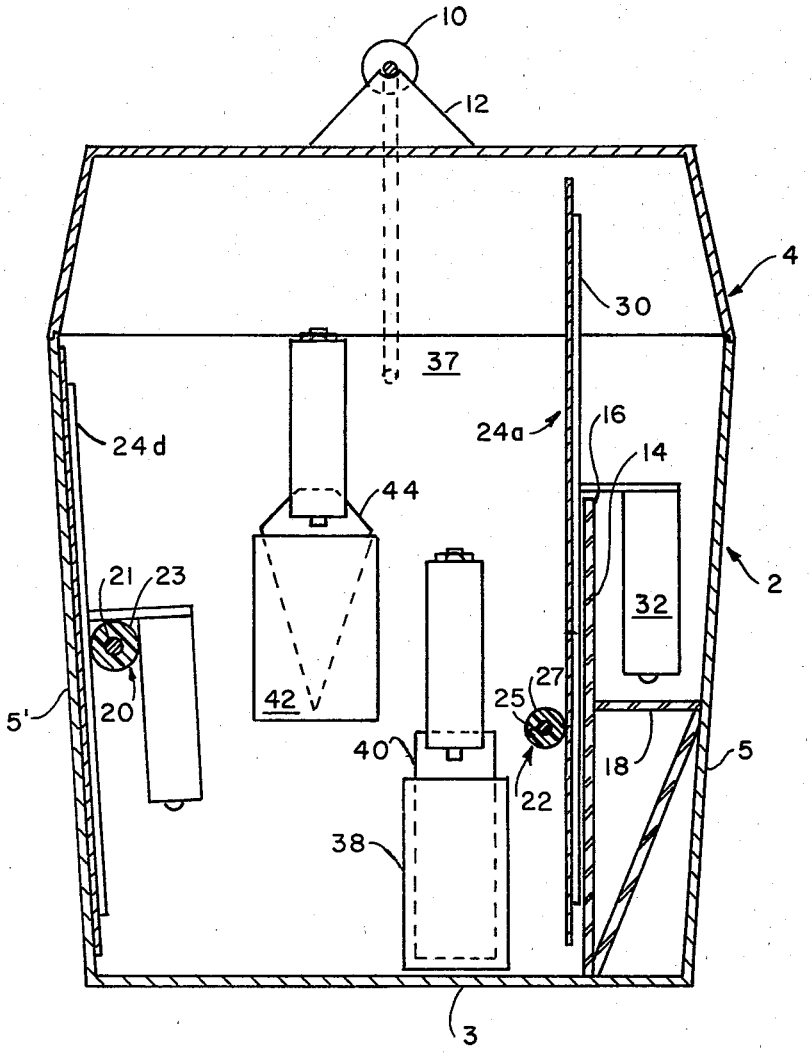
FIG. 3 is a vertical section taken on the line 3—3 of FIG. 1, with the bail in carrying position.

Taking trowel **24*a* as an example, and referring to FIGS. 1 and 3, each finishing trowel comprises a blade 30 and a handle 32, having an axis substantially parallel to the plane of the blade. The handle is joined to the blade by a support 34, which is substantially perpendicular to the plane of blade 30. Some of the finishing trowels are inserted in the case with support 34 resting on wall 14. Bar 22 grips and stabilizes the blades. Other finishing trowels, exemplified by trowel 24*d*, FIG. 3, are carried ajacent to wall 5' with blade 30 gripped between resilient rod 20 and the wall and with support 34 resting on rod 20. For improved stability of these trowels, wall 5'** is sloped slightly outwardly from the vertical.

The wall 14 should extend at least several inches above and below shelf 18 to provide firm engagement with blade 30. It may reach to bottom 3. This provides a rigid structure, but is not essential. On at least one end wall, 37, I provide a pocket 38 of a size and shape to receive a margin trowel 40 and a pocket 42 of a size and shape to receive a mason's trowel 44.

As best seen in FIGS. 1 and 3, there is considerable free space on the shelf 18 between interior wall 14 and sidewall 5 which may be used for gloves and small articles. There is a larger space between the interior wall 14 and sidewall 5' which may be used for, e.g., boots.

In a specific embodiment, the body portion is 18 inches long, 16 inches wide at the bottom, and 17 inches wide at the top. The shelf 18 is 3 inches wide and spaced 5 inches above bottom 3. Edge 16 of interior wall 14 extends 10 inches above the bottom 3. The top of rod 20 is 8½ inches above bottom 3. Exterior side and end walls are 17 inches high and the total height to the top of cover 4 is 22 inches. This leaves space between interior wall 14, sidewall 5' and the end walls, which is 13 inches wide and 18 inches long.

I claim as my invention:

1. A carrying case for cement finisher's tools comprising a body portion on having a substantially horizontal bottom, substantially vertical exterior end walls and upright exterior side walls joining said end walls; a removable cover adapted to close the top of said body portion; and a carrying bail pivotally secured to opposite walls; at least one interior wall parallel to and spaced inwardly at least 3 inches from one of said exterior walls; and a horizontal shelf member joining said interior wall with the last-named exterior wall, said interior wall being much closer to said last-named exterior wall than to the wall opposite thereto and extending several inches upwardly from said shelf, said interior wall and shelf being to constructed and arranged that a cement finisher's finishing trowel can be hung on said interior wall with the handle between said exterior an interior walls, and means adjacent the inner surface of said interior wall constructed and arranged to stabilize the blade of such a trowel against said interior wall when it is so hung, said surface being otherwise unobstructed.

2. A carrying case as defined in claim 1 wherein said interior wall extends both upwardly and downwardly for several inches in each direction from said shelf, and said means for stabilizing comprises a bar parallel to and closely adjacent said interior wall and positioned below said shelf.

3. A carrying case as defined in claim 2 wherein said interior wall is spaced from and joined by said shelf to one of said exterior side walls.

4. A carrying case as defined in claim 1 and further comprising a gripping bar closely adjacent to and parallel to the inner surface of a second exterior wall at a height approximately the same as that of the top of said interior wall.

5. A carrying case as defined in claim 4 wherein said gripping bar is adjacent to the exterior wall opposite to that to which said interior wall is joined, and the space between said walls is substantially unobstructed.

6. A carrying case as defined in claim 4 in which the outer surface portion of said gripping bar is resilient.

7. A carrying case as defined in claim 4 and further comprising at least one pocket mounted on the inner surface of a third exterior wall, said pocket having a shape and size to receive a type of trowel other than a finishing trowel.

8. A carrying case as defined in claim 7 wherein there are a plurality of said pockets, at least one of said pockets having a size and shape to receive a margin trowel and at least one having a size and shape to receive a mason's trowel.

9. A carrying case as defined in claim 2 and further comprising at least one finishing trowel hung on the top of said interior wall, with its handle between said interior wall and said exterior wall and its blade between said bar and said interior wall.

* * * * *